US008833290B2

(12) United States Patent
Mueller

(10) Patent No.: US 8,833,290 B2
(45) Date of Patent: Sep. 16, 2014

(54) LIGHT-WEIGHT PLATFORM HAVING STAIRS

(76) Inventor: Peter A. Mueller, Gattikson (CH)

( * ) Notice: Subject to any disclaimer, the term of this patent is extended or adjusted under 35 U.S.C. 154(b) by 0 days.

(21) Appl. No.: 13/261,348

(22) PCT Filed: Jan. 13, 2010

(86) PCT No.: PCT/CH2010/000009

§ 371 (c)(1),
(2), (4) Date: Nov. 2, 2012

(87) PCT Pub. No.: WO2011/085504

PCT Pub. Date: Jul. 21, 2011

(65) Prior Publication Data

US 2013/0047909 A1 Feb. 28, 2013

(51) Int. Cl.
*B63B 17/00* (2006.01)

(52) U.S. Cl.
USPC ..... 114/362; 114/343

(58) Field of Classification Search
USPC ..... 114/362
See application file for complete search history.

(56) References Cited

U.S. PATENT DOCUMENTS 5,794,292 A * 8/1998 Ricci, Jr. ..... 14/69.5
5,950,267 A * 9/1999 Ricci, Jr. ..... 14/71.1
6,047,659 A * 4/2000 Schmidt, Jr. ..... 114/369
6,125,491 A * 10/2000 Alexander ..... 14/69.5
6,786,170 B2 * 9/2004 Trowbridge ..... 114/259
6,904,863 B2 * 6/2005 Mardikian et al. ..... 114/362
6,942,062 B2 * 9/2005 Schmid, Jr. ..... 182/84
7,121,226 B2 * 10/2006 Grimaldi ..... 114/362
7,182,175 B1 * 2/2007 Schmitt et al. ..... 182/88
7,341,016 B2 * 3/2008 Terleski et al. ..... 114/343
7,503,276 B1 * 3/2009 Curi et al. ..... 114/362
8,091,294 B2 * 1/2012 Whalen ..... 52/183
8,375,880 B1 * 2/2013 St. Clair et al. ..... 114/362
2006/0075952 A1 4/2006 Grimaldi
2010/0212576 A1 * 8/2010 Muller ..... 114/362
2010/0288179 A1 * 11/2010 Grimaldi ..... 114/362
2011/0017122 A1 * 1/2011 Muller ..... 114/362
2013/0047909 A1 * 2/2013 Mueller ..... 114/362

* cited by examiner

*Primary Examiner* — Lars A Olson
*Assistant Examiner* — Jovon Hayes
(74) *Attorney, Agent, or Firm* — Oliff PLC

(57) ABSTRACT

The invention comprises a segmented platform (1) for watercraft which, which serves as a stair lift, swimplatform or gangway and can be lowered by an active or passive cylinder (4) and a parallelogram (3). The platform (1) consists of plates (2) and optional lateral lifting bodies (8), as well as of a locker (11,12) whereby the whole unit can be tilted up by the bearing (6) attached to the side plates (7) and in addition a down stroke (H1,H2,H3) is created by a second parallelogram (28) or pivot mean (29), therefor the watercraft takes up less space when not in use. The plates (2) can have a cover (21) in the form of a strap (18) and when lifting the plates (2) a higher safety for people is made possible.

4 Claims, 5 Drawing Sheets

LIGHT-WEIGHT PLATFORM HAVING STAIRS

This application claims priority of PCT application PCT/CH2010/000009 having a priority date of Jan. 13, 2010, the disclosure of which is incorporated herein by reference.

TECHNICAL FIELD

The invention is based on a light weight segmented platform which serves as a stair and swim platform and preferably is fixed at the transom of a watercraft and on request can be entirely folded up, especially suitable for tender craft so as not to take up further standing space for the platform in the garage. In addition the platform can be self-carrying with a static lifting force as swim bodies are placed laterally to the platform, which, whilst cruising also create a dynamic lifting. Due to the light weight system a light weight cylinder system is also possible so that in connection with the protected shifting mechanism, which has a safety mean as for example a front cover for the stair steps, thereby the danger of cuts and bruises is reduced.

BACKGROUND OF THE INVENTION

Rigid platforms are known in the boating sector on which manual, mostly telescopic extendable ladders are fixed as described in patent EP 1 616 782 A1, in the case of ships extendable steps are used, that run hydraulically and also by the use of a winch as described in patent MXPA 0201 1583, in the case of leisure yachts extendable ladders as well as stairs with horizontal steps are also in use which can be activated hydraulically or electrically. Passengers and animals use these as a convenient way of getting into or out of the water. Large ships also use the stairs as a way for going on land.

The engine driven ladders and stairs are directly integrated in the watercraft or stored in boxes in the swimplatforms and are horizontally fully extentable and can be tilted down towards the water by the use of an articulated joint, as described in patent FR 2878822. In many cases the tilting is effected by an additional cylinder. A combination of a rigid swimplatform and movable stair elements is described in US patent 2006/0075952 A1, whose step elements are tiltable but do not have the safety elements with regard to cutting and bruising. Known are also drop down swimplatforms which can be lowered to below the waterline with the special use for collecting tenders and jetskis as described in, for example, patent DE 199 63 057 C1.

SUMMARY OF THE INVENTION

The invention involves that, an overhanging, segmented plate is fixed at the stern of a watercraft which has the function of a swimplatform as well as a lowerable stair and as an option has the function of a gangway and when not in use the whole thing can be tilted away.

More and more boats and yachts are being equipped at their stern with swimplatforms or stairs, on the one hand by using the swimplatform to be closer to the water or to be able to facilitate putting on the waterskis; on the other hand, equipped with a stair, to get to and from the boat or yacht. Many swimplatforms have extendable stairs, so called chicken ladders, so that one can get better into or out of the water. Dropdown swimplatforms are a luxury but very convenient and are mostly acquired for their tender lifting function.

The invention has the advantage of having a swimplatform with an extendable tiltable stair equipped with constantly fixed horizontal stair steps which only can be found on large yachts. All these functions are stored in an elegant, space saving tiltable way in the swimplatform, so that such swimplatform in dry dock or as part of a tender in a yacht garage, hardly takes up space, with regard to length.

As stair steps are not clearly visible underwater, the stair steps are separated from each other by means of a movable mean but in such a way that no limbs can get stuck in between the stair steps when bringing up the system. In the version with a light gas spring such a cover is not foreseen as the gas spring can only lift up the weight of the stair and not that of a person.

As the lateral swim bodies on the platform create a better trim of the watercraft and relieve the stern from the additional platform weight and allow a dynamic lift while cruising, i.e. higher stability and improved glide angle of the craft.

The light weight swim platform with the stair function is not only directed towards the lowering of the elements but can be driven up into a high position so that it can be used as a gangway.

Core of the invention is that a swimplatform with a stair function with a high safety standard is fixed at the stern of a watercraft which can be lowered or lifted by means of an active or passive cylinder and is also tiltabe for space saving parking of the watercraft

BRIEF DESCRIPTION OF THE DRAWINGS

Various exemplary aspects of the invention will be described with reference to the drawings, wherein. Same elements are named in the various figures with the same reference signs.

A schematic overhead view of a segmented plate with cylinders and lifting bodies and the pivot mean fixed on the sides for raising the plate

FIG. 2

A schematic side view of the segmented plate with the swivel mean for raising and locking the plate and for lowering the plate under the waterline shown here by the dotted lines

FIG. 3

A schematic side view of of the segmented plate with a cylinder and the latching mean and the possible gangway position shown here by the dotted lines

FIG. 4

A schematic side view of the segmented plate with the lifting bodies and railing

FIG. 5

A schematic side view of the segmented plate with a pliable, rollable cover

FIG. 6

A schematic side view of the segmented plate turned by 180 degrees with an elevated intermediate element

FIG. 7

A schematic sideview of the segmented plate turned by 90 degrees with a lowered intermediate element

FIG. 8

A schematic side view of the segmented plate turned by 90 degrees and lowered by the mean to lower the position of the platform.

Only essential elements of the invention are schematically shown to facilitate immediate understanding.

DETAILED DESCRIPTION OF THE PREFERRED EMBODIMENTS

Figure 1:
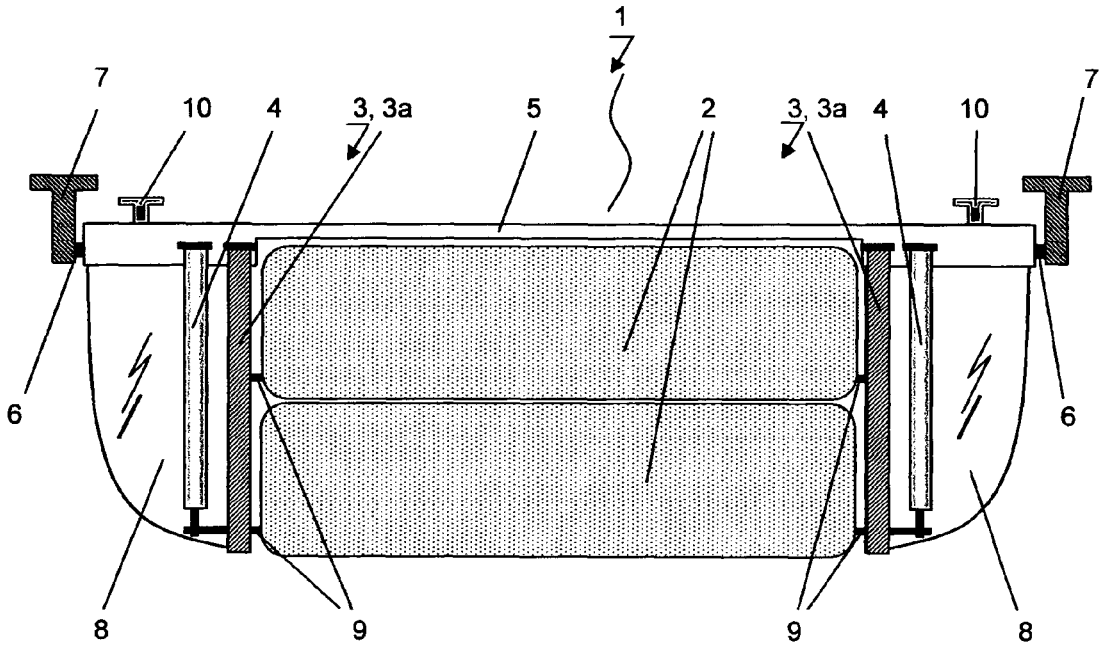
FIG. 1

FIG. 1 shows a schematic overhead view of a segmented platform 1 with two parallel plates 2 which are fixed laterally on a parallelogram 3, consisting of an upper arm 3*a* and a lower arm 3*b*. Beside it are two cylinders 4 for raising or lowering the platform 1 which is also only operable by means of a cylinder and which can be for example centrally fixed under the plates 2. Parallelogram 3 and cylinder 4 are hinged and fixed to the pivot plate 5 which in turn is hinged and mounted to the side plates 7 by bearing 6. The side plates 7 are connected to the transom of the watercraft. Furthermore a lifting body 8 is fixed on each side onto the pivot plate 5.

This simple construction becomes even more effective to handle if the step bearing 9, which is connected to the parallelgram 3, is fixed downstream at the end of plates 2 so that a maximum amount of stair travel is generated by lowering the parallelogram 3 with the activation of cylinder 4. The lifting bodies 8 create a static lift and prevent or reduce an overtrim of the watercraft by an additional weight load at standstill based on the fixing of the platform 1 to the watercraft's transom, especially if the lifting is identical to the weight of the platform 1. Furthermore the lifting bodies 8 generate a dynamic lifting whilst cruising and in addition stabilize the watercraft. As the lifting bodies 8 are smartly attached to the pivot plate 5, the cylinder 4 and parallelogram 3 are covered simultaneously so that the plate 1 and both lifting bodies 8 form a surface.

The pivot plate 5 supports itself against the watercraft's transom and can be pushed in or out by adjustment mean 10, in such a way that the pivot plate 5 and the lifting bodies 8 as well lie horizontal in relation to the watercraft. By releasing the locker, not shown here, the whole platform 1 including the lifting bodies 8 can be pivoted up over the pivot plate 5 and its bearing 6 and can be placed vertically or further, for example, on the sunbathing area of the watercraft, so that when the watercraft is in dry dock space is saved. In case the platform 1 is fixed on a tender boat, it can be tilted accordingly and make room on such yachts with limited garage space. Instead of directly tilting, a link between bearing 6 and side plate 7 can be inserted, so that with such a link it can be first of all tilted downwards before tilting up and thus in gaining height or vice versa, the pivoting point may be lowerd when the platform 1 is tilted up in the garage.

Figure 2:
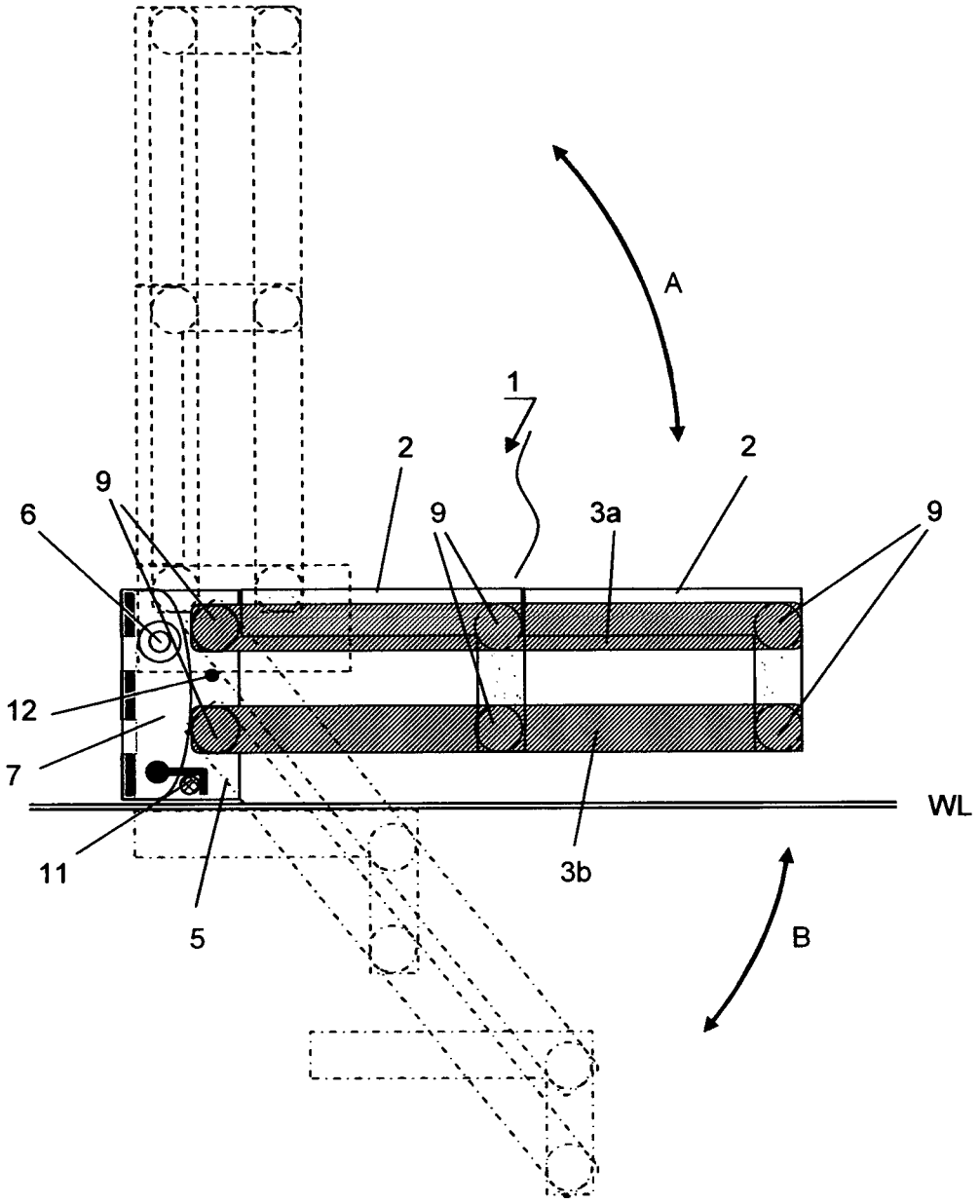

FIG. 2 shows a schematic side view of the segmented platform 1 with the bearing 6 which, in the case of narrow parking conditions in the watercraft, the platform 1 may be tilted according to arrow A. In heavy seas the platform 1 cannot basculate due to the locker 11, but when horizontally tilted out is fastly fixed to the transom of the watercraft. In addition, a lifting latch 12 is provided so that, when the platform 1 is tilted up, also remains in position. The lifting latch function can also be done by a self-locking, blockable cylinder 4. The locking of the locker 11 or the lifting latch 12 can be done manually or electrically or by fluid. Once the platform 1 is tilted down and fixed to the locker 11, the plates 2 can be lowered under the waterline WL by the parallelogram 3 according to arrow B.

Figure 3:
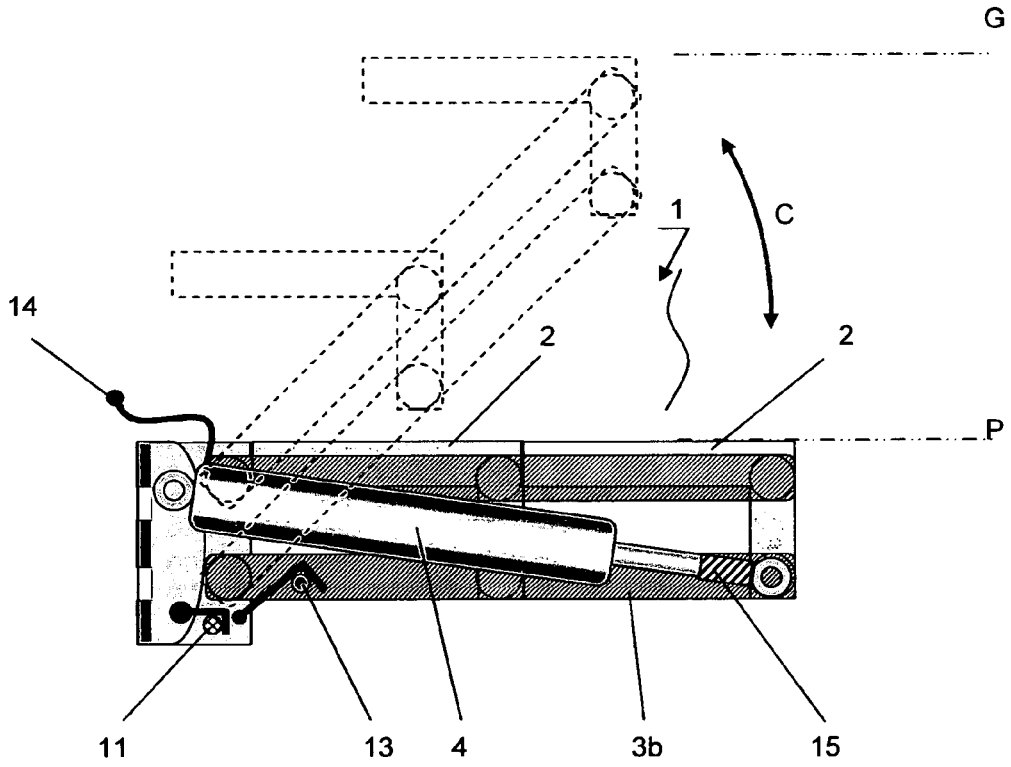

FIG. 3 shows a schematic side view of the segmented platform 1 with a cylinder 4 which in this case can be a gas spring with a latching mean 14. The cylinder 4 is fixed here on the side plate 7, the opposite side, i.e. the piston rod for example on the lower arm 3*b*. It is highly unlikely that cutting and bruising will occur on this reasonably priced version, as the pushing, respectively the pulling forces are small and only the weight of the plate 2 is brought safely and reliably into the horizontal position P. A positioning thread 15 on the cylinder 4 assures the required alignment. Such a blockable cylinder 4 keeps the plates 2 in position. When activating the latching mean 14 by a button, the platform 1 can only be lowered when there is weight on the plates 2. When releasing the button for the latching mean 14, the cylinder 4 is locked. After use of the stair the latching mean 14 can be released again and the plates 2 go up automatically to position P. When releasing the latching mean 14, the cylinder 4 is locked again. This can also be accomplished by a simple stanchion or and simple locking mean instead of the latching mean 14. Of course, the cylinder 4 can also be an electric cylinder with a spindle drive.

By means of the gangway latch 13, which can be activated manually or electrically or by means of a fluid the parallelogram can be swiveled further up according to arrow C so that the plates 2 are driven up to the position G and serve, for example, as an aid to enable persons to get better onto land.

Figure 4:
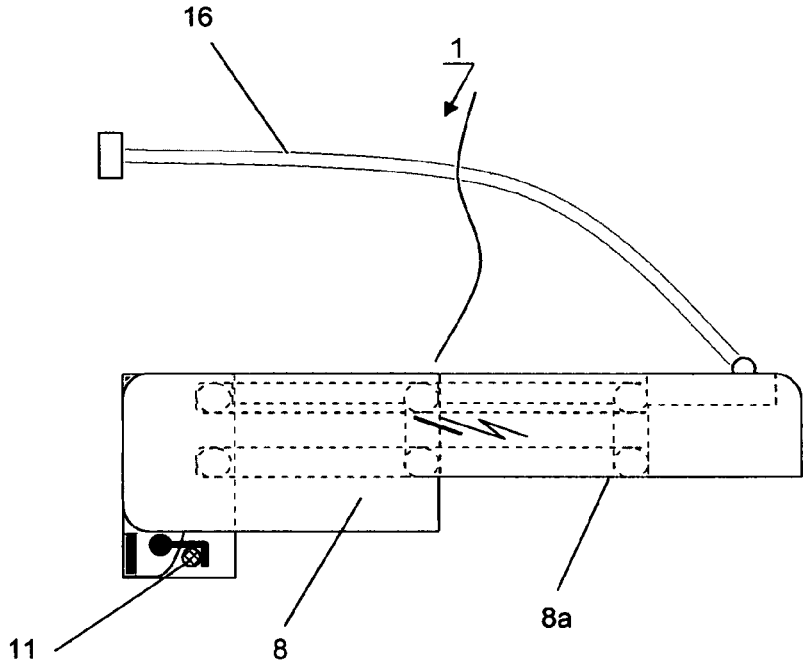

FIG. 4 shows a schematic side view of the segmented platform 1 with the lifting body 8 having a static lifting element when at rest and having a dynamic lifting element when cruising, which by means of a step 8*a* furthermore reduces or completely eliminates the friction on the lifting body 8 when travelling at higher speeds. So that the forces on the lifting body 8 do not have to be fully borne by the side plate 7, respectively by bearing 6 and pivot plate 5, a releasable, folding railing 16 is fixed to the stern of the watercraft and to the lifting body 8 and therefore has a dual function in that it increases the stability of the platform 1 and in addition is a convenient handrail facilitating the getting into or out of the water for swimmers.

Figure 5:
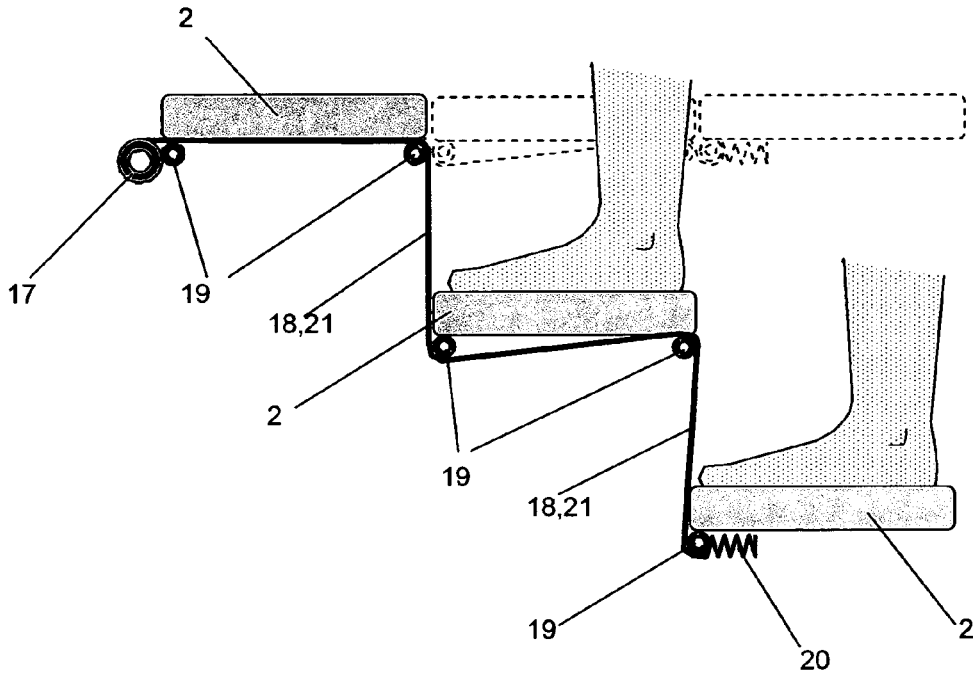

FIG. 5 shows a schematic side view of the segmented platform 1 with a blind 17 which is a bearing fitted tube on the pivot plate 5 or side plate 7 or stern or under the first plate 2 with a roll up spring or with a force adjusted lift on which a strap 18, preferably made out of plastic and covering as much as the full width of the plate 2 and by using the guide pulley 19, creating a flexible, rollable, adjustable cover 21. A spring 20 keeps the strap 18 constantly under tension. Instead of a cylinder 4 in the form of a gas spring, a hydraulic or electric version is built in the plate 1, to lift persons or objects. It could be extremely problematic if limbs became trapped in the ascending plates 2 and therefore a cover 21 is advantageous in these instances.

Figure 6:
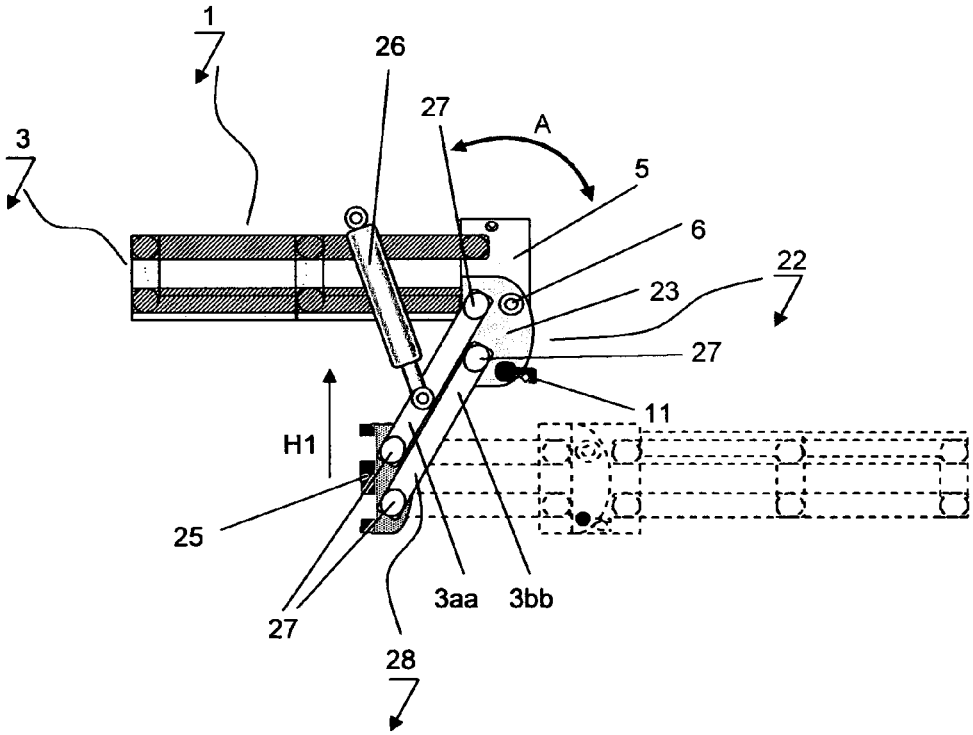

FIG. 6 shows a schematic side view of the segmented platform 1 in the 180 degree folded position and a raised intermediate element 22. This consists of a second parallelogram 28 with an upper arm 3*aa* and a lower arm 3*bb* and the swivel bearings 27, on one side of which an intermediate sideplate 23 with the locker 11 and, if necessary, with the lifting latch 12, not shown here, as well as with the gangway latch 13 fixed and on the other side the attachment plates 25 are mounted. In order to position the second parallelogram 28, a lifter 26 has been fixed to the upper arm 3*aa* which is fitted to the stern of the watercraft or to an extended attachment plate 25. The lifter 26 can be accordingly adjusted mechanically, electrically, hydraulically in length or fitted and positioned in such a way by means of the appropriate hole pattern in the upper arm 3*aa* that the second parallelogram 28 changes its angle accodingely so that a stroke according to arrow H1 takes place on the intermediate sideplate 23. When tilting the platform 1 over the bearing 6 according to arrow A, it can be laid on the engine cover of the watercraft and thus shortens the floor space of the watercraft.

Figure 7:
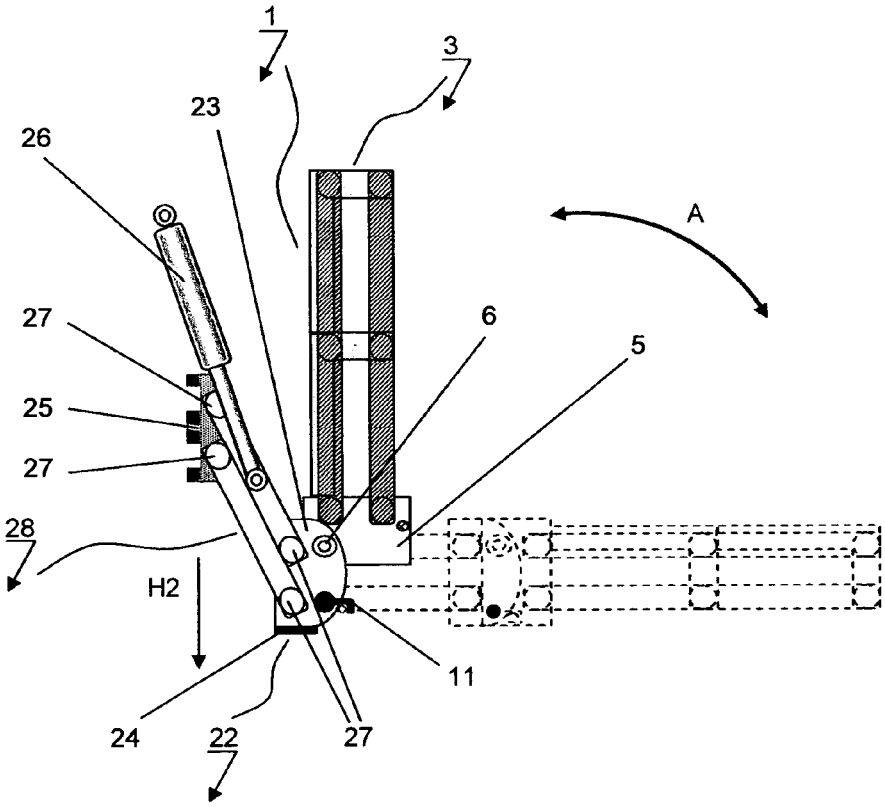

FIG. 7 shows a schematic side view of a segmented platform 1 tilted by 90 degree angle with a lowered intermediate element 22. The intermediate element 22 matches the parts and function described in FIG. 6. The lifter 26 can be a mechanical part or a cylinder 4. When lowering the intermediate sideplate 23 according to arrow H2, the final height of the platform 1 is reduced when tilting the platform 1 up according to arrow A, having an advantageous role for certain types of yacht garages. Furthermore the intermediate sideplate 23 can have a stand up function by means of a standing plate 24 which prevents the watercraft from tilting sideways if the appropriate chocks are not available.

Figure 8:
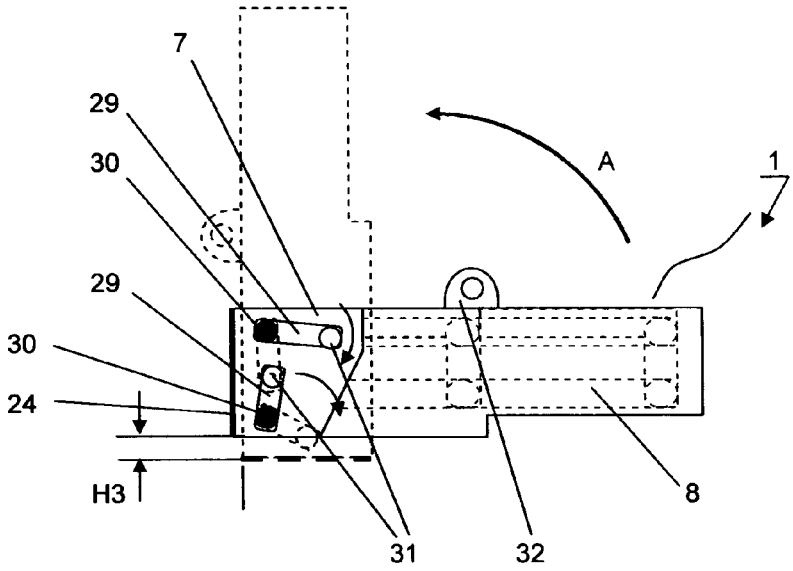

FIG. 8 shows a schematic sideview of the segmented plate 1 with a lifting body 8 tilted by 90 degrees according to arrow A and lowered at the down stroke travel H3 by means of a pivot mean 29 set, which is fixed to the side plate 7 by means of pivot bearing 30 and the pivot mean 29 are also hinged on the lifting bodies 8 by the turning bearing 31. Should the lifting body 8 not be in use, then the turning bearing 31 is fixed directly to the platform 1. By pulling or pushing up the lifting body 8 to the eye 32 the lifting bodies 8 are pivoted according to the tilting stroke A and due to the appropriately positioned pivot mean 29, a kinematic movement is triggered, which allows the lifting body 8 to be turned around the pivot bearing 30 and turning bearing 31 and thereby the lifting body 8 is tilted for example by 90 degrees and at the same time the lifting body 8 is lowered by the down stroke H3 by the kinematics of the pivot mean 29. The pivoting of the lifting body 8 can be supported by the pivoting springs—not shown here—on the pivot bearing 30 or and turning bearing 31, also the inclination of the lifting body 8 and the downstroke H3 can be affected by a pivot mean 29 set of uneven length. If provision has been made at the front end of the platform 1 or on the lifiting body 8 for a standing place 24, then the entire watercraft can be stabilized in dry dock and will not tilt inspite of its V-shaped hull.

Of course the invention is not only applicable on shown and described examples.

DRAWING LIST

1 platform
2 plate
3 parallelogram
3*a*,3*aa* upper arm
3*b*,3*bb* lower arm
4 cylinder
5 pivot plate
6 bearing
7 side plate
8 lifting body
8*a* step
9 step bearing
10 adjustment mean
11 locker
12 lifting latch
13 gangway latch
14 latching mean
15 positioning thread
16 railing
17 blind
18 strap
19 guide pulley
20 spring
21 cover
22 intermediate element
23 intermediate sideplate
24 standing place
25 attachment plate
26 lifter
27 swivel bearing
28 second parallelogram
29 pivot mean
30 pivot bearing
31 turning bearing
32 eye
P horizontal position
G gangway position
WL waterline
H1,H2 stroke
H3 down stroke
B,C plate travel
A tilting stroke

The invention claimed is:

1. A platform for a watercraft comprising:

a side plate that is capable of being connected to the watercraft;

a lifting body; and a pivot set that connects the side plate to the lifting body such that the lifting body can be pivoted relative to the side plate between a substantially horizontal position and a substantially vertical position, wherein the pivot set connects the side plate to the lifting body such that the lifting body as a whole is lowered when the lifting body is tilted up to place the lifting body in the substantially vertical position.

2. The platform according to claim 1, wherein the pivot set includes a pivot bearing that is attached to the side plate and a turning bearing that is attached to the lifting body.

3. The platform according to claim 2, wherein the pivot set connects the side plate to the lifting body such that, when the lifting body is pivoted relative to the side plate, a kinematic movement is triggered, which allows the lifting body to be turned around the pivot bearing and the turning bearing so that the lifting body is tilted upward and at the same time lowered.

4. The platform according to claim 1, wherein the pivot set connects the side plate to the lifting body such that, when the lifting body is pivoted relative to the side plate, a kinematic movement is triggered, which allows the lifting body to be tilted upward and at the same time lowered.

* * * * *